United States Patent [19]

Mayer et al.

[11] 3,961,951

[45] June 8, 1976

[54] ELECTROPHOTOGRAPHIC METHOD FOR PRODUCING MULTIPLE COPIES FROM THE SAME ELECTROSTATIC IMAGE

[75] Inventors: Edward F. Mayer, Acton, Mass.; Robert A. Moore, Nashua, N.H.

[73] Assignee: Itek Corporation, Lexington, Mass.

[22] Filed: Dec. 26, 1974

[21] Appl. No.: 536,712

[52] U.S. Cl. ..... 96/1.4; 427/24

[51] Int. Cl.[2] ..... G03G 13/14

[58] Field of Search ..... 96/1.4; 427/24

[56] References Cited

UNITED STATES PATENTS

| | | | |
|---|---|---|---|
| 3,203,394 | 8/1965 | Hope et al. | 427/24 |
| 3,363,555 | 1/1968 | Olden | 96/1.4 |
| 3,473,923 | 10/1969 | Ohkubo et al. | 96/1.4 |
| 3,837,741 | 9/1974 | Spencer | 96/1.4 |
| 3,862,848 | 1/1975 | Marley | 96/1.4 |

*Primary Examiner*—Jack P. Brammer

*Attorney, Agent, or Firm*—Homer O. Blair; Robert L. Nathans; David E. Brook

[57] ABSTRACT

An electrophotographic method is disclosed which produces multiple electrophotograhic copies from the same electrostatic image by multiply cycling the electrostatic image through development and transfer steps. To reduce copy density losses in subsequent copies, the biasing potential applied across the development zone is reduced on subsequent cycles of the electrostatic image through the development zone.

10 Claims, 3 Drawing Figures

ELECTROPHOTOGRAPHIC METHOD FOR PRODUCING MULTIPLE COPIES FROM THE SAME ELECTROSTATIC IMAGE

BACKGROUND OF THE INVENTION

1. Field of the Invention

The present invention relates to the field of electrophotographic copying, and more particularly, to a method of electrophotographic copying whereby multiple copies can be formed from the same electrostatic image.

2. Description of the Prior Art

In customary electrophotographic processes, a conductive backing having a photoconductive insulating layer thereon is electrostatically imaged by first uniformly charging its surface, and subsequently exposing the charged surface to a pattern of activating electromagnetic radiation, such as light. The radiation pattern selectively dissipates electrostatic charges in the illuminated area on the photoconductive surface, which results in formation of a latent electrostatic image in non-illuminated areas. This latent electrostatic image can be developed to form a visible image by depositing developer materials thereon by a variety of development techniques, the most common of which is cascade development.

Typically, each latent electrostatic image is developed only once, thus producing one electrophotographic copy for each charging/exposure cycle. While not commonly practiced, methods have been proposed in which multiple electrophotographic copies are formed from each latent electrostatic image. Typically, such processes involve repeatedly cycling an electrostatic image through the development and transfer steps. See, for example, Kaupp U.S. Pat. No. 3,685,896. Such techniques have not generally been commercially accepted, however, because of certain problems inherent therein, and one such problem relates to loss of image density on copies beyond the first.

SUMMARY OF THE INVENTION

The invention relates to a method for forming multiple electrophotographic copies from the same latent electrostatic image. Losses in subsequent copy density are reduced by lowering the biasing potential applied across the development zone as subsequent development cycles are performed.

This technique is well suited for use in typical electrophotographic copiers having a xerographic drum and a cascade development system since such copiers often include a development electrode positioned adjacent to the xerographic drum surface. A uniform biasing potential is usually applied to the development electrode to improve continuous-tone development and reproduction of solid blacks. The method described herein can be practiced, therefore, by causing the biasing potential applied at the development electrode to undergo an orderly reduction as subsequent copies are made from the original electrostatic image. For example, an initial biasing potential of about 200 volts can be reduced by approximately 10 volts each time the electrostatic image on the photoconductive drum surface is redeveloped. Thus, in a multiple copy run, the final biasing potential would be around 50 volts by the fifteenth copy.

Although it has been recognized that there was a reduction in voltage of the electrostatic image on successive development cycles, the source of the voltage loss has not been fully understood. Whereas it might seem that the voltage loss was due to dark decay of the photoconductor, it now appears that the transfer step is a more significant factor.

By practicing this invention, reductions in the biasing potential are used to offset reductions in electrostatic image voltage thereby reducing or eliminating subsequent copy density losses which would otherwise occur. The reductions in biasing potential do not result in concomitant increases in background development.

DESCRIPTION OF THE PREFERRED EMBODIMENTS

Figure 1:
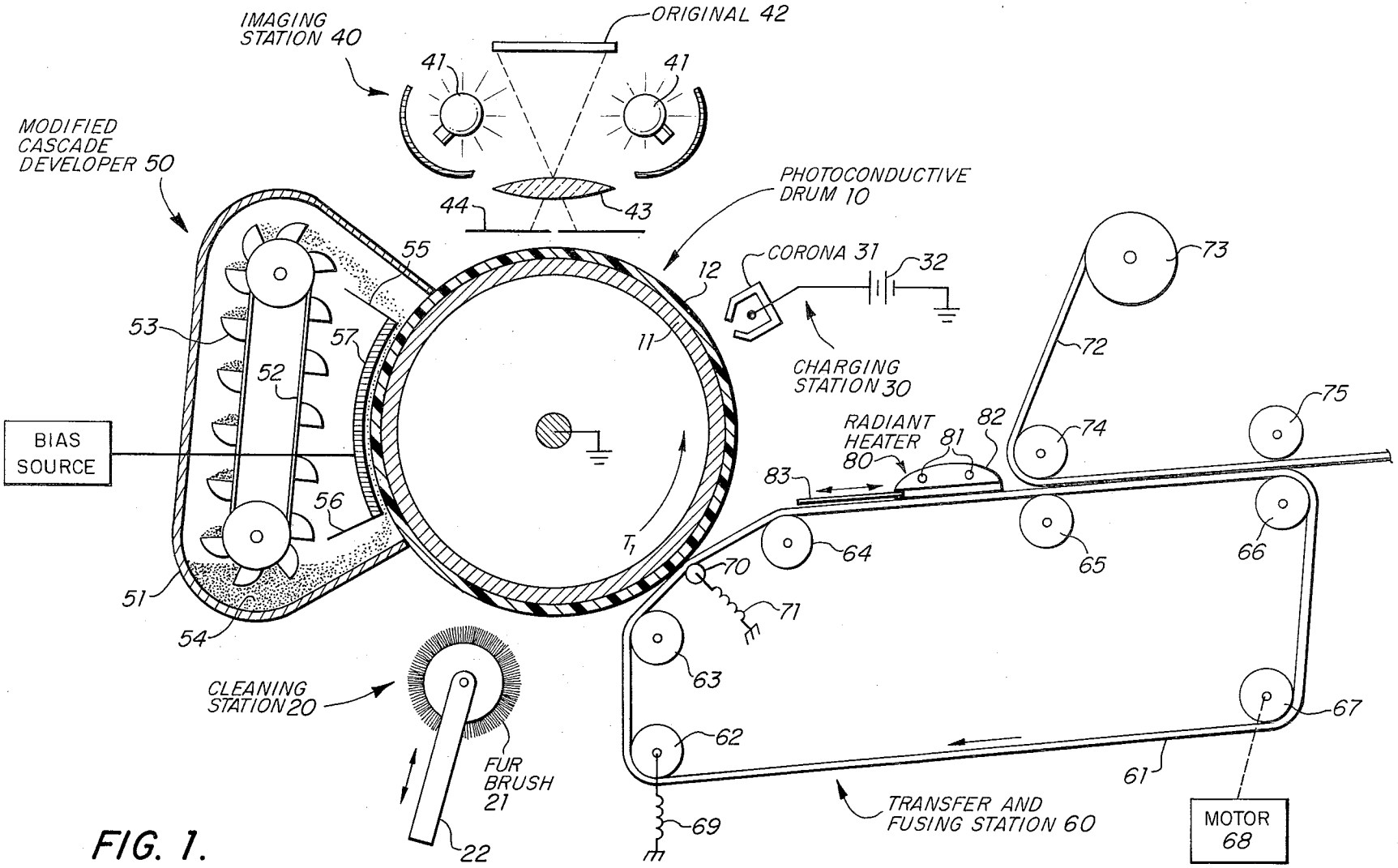
FIG. 1 illustrates schematically an electrophotographic copying apparatus employing a development electrode with a biasing potential applied thereto in a typical cascade development system.

Referring now to the Figures in more detail, FIG. 1 illustrates a photoconductive drum 10 which typically consists of a conductive metal substrate 11, such as aluminum, coated on its outer surface with a layer of photoconductive insulating material 12, typically vitreous selenium. Drum 10 rotates at its axis and is shown rotating in a counter clockwise or "downhill" direction.

A cleaning station 20 is provided to remove residual toner from the photoconductive drum 10 prior to the start of each imaging sequence. Cleaning station 20 includes a fur cleaning brush 21 mounted on slidable element 22 so that the brush can be disengaged.

A uniform electrostatic charge is formed on the surface of drum 10 by means of corona charging station 30. This station includes corona element 31 which is electrically connected to a power source such as battery 32 and to ground.

Uniformly charged drum 10 then passes imaging station 40. Light sources 41 illuminate original 42 which is imaged through imaging lens 43 and slit 44 to form an electrostatic latent image of the original on the surface of photoconductive drum 10. Scanning optics can also be used, of course.

Cascade development apparatus 50 includes a housing 51 containing a bucket elevator system formed by an endless belt 52 having buckets 53 thereon. Electroscopic developer is lifted from a reservoir section 54 in buckets 53 to a point at the upper portion of drum 10 and then cascaded over the drum surface by means of feed guide 55. As developer cascades through the development zone, toner particles separate from the carrier beads and deposit on the drum surface in accordance with the latent electrostatic image thereon, thus forming a visible toner image. Spent developer is guided back into reservoir 54 by guide 56. The biased development electrode 57 is illustrated as having a smooth surface, but a roughened surface which might be formed by knurling its surface or otherwise forming protuberances thereon. A roughened surface interferes with the normal flow of developer and is particularly effective at increasing the radial velocity of developer through the development zone to effect increased developer efficiency. For a more detailed description of this type of roughened electrode, see copending application Ser. No. 429,616, filed Jan. 2, 1974, and now abandoned.

Other development apparatuses could be used, of course, including development systems as magnetic brushes, fur brushes, fluidized bed developers, conventional cascade systems, cascade development apparatus modified by moving belts, uphill cascade developers, etc. These systems are well known to those skilled in the art.

Transfer and fusing station 60 contains an intermediate transfer belt 61 trained to pass in an endless loop around rollers 62, 63, 64, 65, 66 and 67. Belt 61 is driven by suitable means such as motor 68 which is connected to and drives roller 67 in a clockwise direction. Roller 62 can be adjusted by tensioning spring 69 to take up any slack created in intermediate transfer belt 61 caused by any dimensional changes due to variations in temperature or otherwise. Roller 62 is also preferably constructed of hard rubber which is electrically leaky so that any background electric charges built up on belt 61, such as triboelectric charges built up between any of the rollers and the belt, will dissipate naturally before the belt contacts photoconductive drum 10.

Transfer is accomplished at $T_1$, i.e., the point at which belt 61 contacts photoconductive drum 10. Transfer is controlled by transfer roller 70 which is positioned at the back side of transfer belt 61 so that it can move belt 61 into and out of contact with drum 10 by adjusting tensioning spring 71. Paper 72 is fed from paper roll 73 and brought into contact with the toner image on belt 61 by guide rollers 74 and 75 acting in cooperation with belt rollers 65 and 66.

Heat is supplied to the toner image on belt 61 by radiant heater 80. Radiant heater 80 consists of two radiant heating lamps 81 surrounded by a heat shield 82 which is properly insulated and slidable shield 83. Slidable shield 83 can be positioned directly under lamps 81 when the copier is in a standby state so that lower amounts of power can be supplied to lamps 81 while still maintaining the chamber at a high temperature. When copying is initiated, slidable shield 83 is moved to the left in which position lamps 81 radiating heat to belt 61 so that copying can begin.

Transfer belt 61 should have certain surface properties so that efficient transfer of toner is possible. The surface should be smooth, have good release properties (e.g., surface free energy below 40 dynes per centimeter), and have the proper hardness (e.g., about 3 to 70 durometers on the Shore A scale).

The copier described above can be operated in multiple copy mode. That is, multiple copies can be made from one drum exposure. This can be achieved by using the following machine cycle: fur brush 21 is engaged with drum 10 to clean prior images and then disengaged; drum 10 is uniformly charged by corona 31; the charged drum 10 is exposed at imaging station 40 to form an electrostatic image thereon; the electrostatic image is developed in cascade developer 50 and part of the resulting toner image is transferred to belt 61 and subsequently to paper 72; the corona 31 and imaging station 40 are then inactivated and the remaining electrostatic image, which may also contain some toner not transferred, is recycled through developer 50; fur brush 21 is left in a disengaged position; transfer belt 61 is left in pressure transfer relationship to drum 10 to pick a second toner image from drum 10 which is then transferred and fused to paper 72 to form a second electrophotographic copy from the same electrostatic image. If more copies are desired from the same electrostatic image, electrostatic image is recycled through the development and transfer step repeatedly until the desired number of copies has been formed. As pointed out above, however, a loss in electrostatic image potential occurs during such recycling through the development and transfer operation, particularly during the transfer operation.

Figure 2:
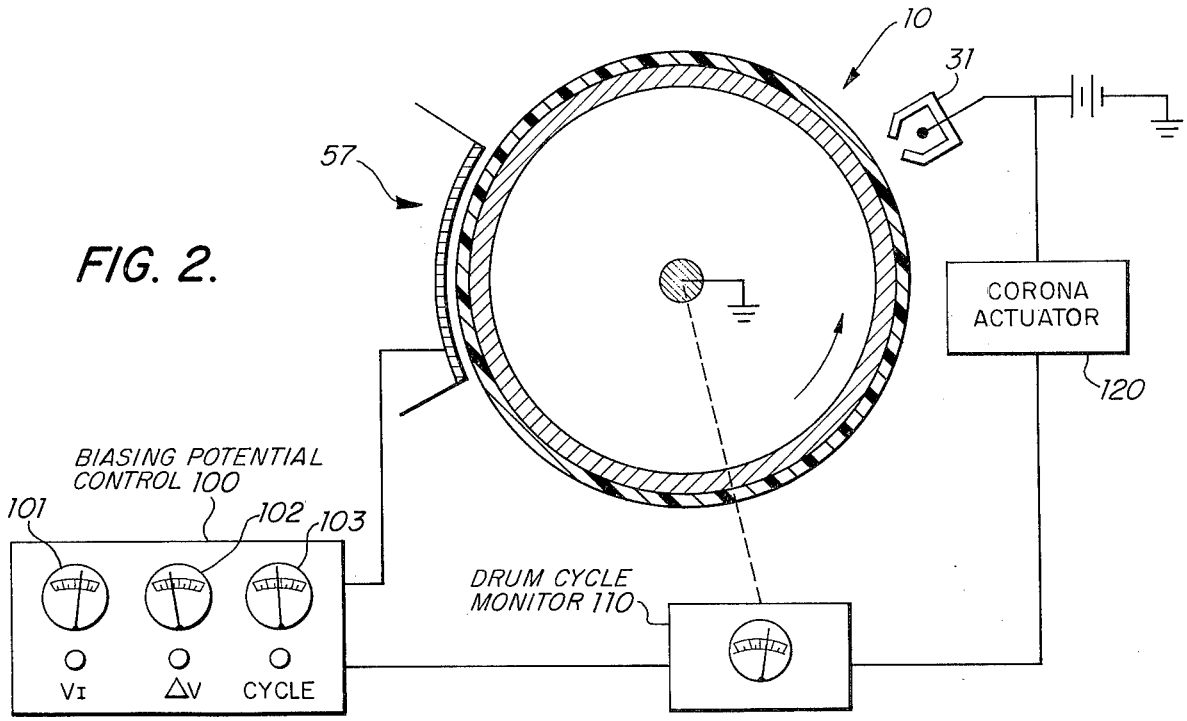
FIG. 2 illustrates schematically one embodiment of this invention for reducing the biasing potential applied to a development electrode positioned adjacent to the surface of a photoconductive drum as multiple copies are formed.

In FIG. 2, photoconductive drum 10, development electrode 57 and corona 31 are shown together with appropriate control devices and circuitry for achieving automatic reduction in the biasing potential on development electrode 57 during subsequent redevelopment cycles to offset the drop of electrostatic image potential. Biasing potential control 100, which can contain a stepping potentiometer, has an initial voltage dial 101, voltage reduction dial 102, and cycle dial 103. An example of its use would be to set dial 101 to +200 volts, dial 102 to 10 volts, and dial 103 to one; this would provide an initial development potential of +200 volts and a 10 volt reduction for each redevelopment cycle. Alternatively, control 100 could be set to drop the development potential by 20 volts on each subsequent redevelopment cycle by turning dial 102 to 20 and dial 103 to 2. Of course, more complex controls could be used to provide a variety of voltage drops for subsequent cycles, such as a 20 volt drop for the first five redevelopment cycles followed by a 10 volt drop for the next five cycles followed by no drop for subsequent cycles. Clearly, those skilled in the art will be able to envision a wide range of permutations and combinations between voltage drops and redevelopment cycles, and these are within the scope of this invention. As shown, control 100 is also connected to a drum cycle monitor 110 which is in turn connected to corona actuator 120. Corona 31 is not activated, of course, during redevelopment cycles of the electrostatic image. Control circuitry is also used to engage or disengage the cleaning brush, etc. When a new electrostatic latent image is formed, biasing potential control 100 will reset the biasing potential to an original value, and automatically reduce the voltage applied by a predetermined amount for subsequent redevelopment cycles of the same electrostatic image.

It should be noted that it is preferable to maintain the biasing potential above a certain minimum value in order to avoid development of background areas in the latent electrostatic image. Using pressure transfer as illustrated in FIG. 1, it is possible to choose materials for drum 10 and transfer members 61 which cause the potential in background areas to drop to very low levels and sometimes even to negative values. Such systems are particularly preferred because the development potential can be lowered more than with systems in which the background potential does not drop as significantly. It is particularly preferred to use an intermediate transfer belt having an elastomeric surface with a hardness of between 3 and 70 durometers, a surface free energy below about 40 dynes per centimeter, and a heat capacity below about $3.1 \times 10^{-3}$ cal/cm$^2$/°C. Such transfer belts are described in detail in U.S. Ser.

No. 308,168, filed Nov. 2, 1972 and now abandoned, and the teachings of this patent application are hereby incorporated by reference.

Figure 3:
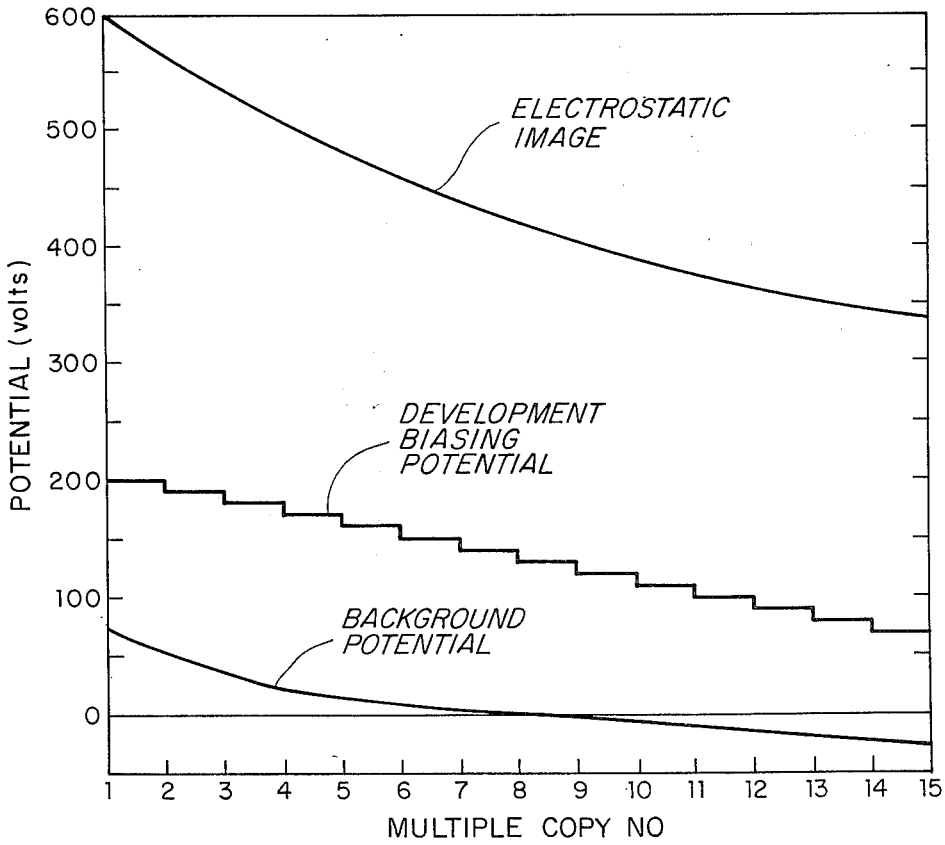
FIG. 3 illustrates graphically values which might be observed during a multiple copy mode of operation according to this invention for typical electrostatic image, background and biasing potentials.

The relationships betweeen the voltage drop in the electrostatic image, background and biasing potential can be further understood by referring to FIG. 3. FIG. 3 represents graphically a typical voltage drop which might be experienced in a multiple copy run comprising 15 copies from one latent electrostatic image. A copier substantially as illustrated in FIG. 1 could be used. The electrostatic image can be seen to have an initial potential of 600 volts whereas background areas have an initial background voltage of about 70 volts. A biasing potential of about 200 volts is applied to the development electrode. Voltage in both the electrostatic latent image and the background voltage drops off significantly throughout the copy run. To maintain image density, the development electrode biasing potential is reduced by 10 volts in each redevelopment cycle which results in a potential of 60 volts at the end of the copy run. At the end of the 15th copy run, the voltage in the latent image is about 325 and the background voltage has dropped below zero.

Many modifications of the specific embodiments described herein can be made, and such equivalents are considered to be within the scope of the invention.

What is claimed is:

1. In an electrophotographic method including the steps of:

Forming an electrostatic image on an insulating surface;

Developing said electrostatic image with toner to form a first toner image on said insulating surface by passing the electrostatic image through a development zone containing developer while applying a biasing potential thereacross;

Transferring toner from said first toner image to a support surface to form a first copy;

Redeveloping said electrostatic image with toner by recycling it through said development zone;

Transferring said redeveloped toner images to a support surface to produce subsequent copies from said electrostatic image;

The improvement comprising reducing the applied biasing potential on successive cycles of said electrostatic image through said development zone to thereby offset reductions in said electrostatic image potential which produces subsequent electrophotographic copies having good image density.

2. The method of claim 1 wherein said insulating surface comprises a xerographic drum having a conductive substrate with a photoconductive, insulating surface thereon.

3. The method of claim 2 wherein said xerographic drum has a photoconductive insulating surface comprising vitreous selenium.

4. The method of claim 1 wherein both of said development and redevelopment cycles are achieved by cascading developer through said development zone.

5. The method of claim 3 wherein both of said development and redevelopment cycles are achieved by cascading developer through said development zone.

6. The method of claim 1 wherein transfer of both said first toner image and said developed toner images is achieved by contacting said toner images on the insulating surface by an intermediate support member to thereby transfer the toner images from said photoconductive insulating surface to said intermediate transfer member and thereafter transferring said toner images from said intermediate support member to copy support members.

7. The method of claim 5 wherein transfer of both of said first toner image and said redeveloped toner images is achieved by contacting said toner images on the insulating surface by an intermediate support member to thereby transfer the toner images from said photoconductive insulating surface to said intermediate transfer member and thereafter transferring said toner images from said intermediate support member to copy support members.

8. The method of claim 1 wherein said biasing potential is reduced by an amount of about 10 volts on each redevelopment cycle.

9. An improvement of claim 7 wherein said biasing potential is reduced by an amount of about 10 volts on each redevelopment cycle.

10. A xerographic process comprising:

a. applying a uniform electrostatic charge pattern to the surface of a xerographic member having a conductive support and a photoconductive, insulating coating thereon;

b. exposing said uniform electrostatic charge pattern to an image to form an electrostatic image thereof;

c. developing said electrostatic image with xerographic developer comprising toner and carrier particles by cascading said developer past said electrostatic image to form a toner image;

d. contacting said toner image with an intermediate transfer member having an elastomeric surface with a hardness of from about 3 to about 70 durometers, a surface free energy of below about 40 dynes/cm and a heat capacity below about $3.1 \times 10^{-3}$ cal/cm$^2$/°C, whereby at least part of said toner image is transferred to the surface of said intermediate transfer member;

e. radiantly heating transferred toner on the surface of said intermediate transfer member to at least its melting point;

f. contacting said heated toner with a copy support whereby it is transferred and fixed to said copy support; and, g. re-cycling the electrostatic image through steps (*c*) through (*f*) and reducing the biasing potential on subsequent development cycles to thereby produce multiple copies from the same electrostatic image.

* * * * *